US009127864B2

(12) United States Patent
Hiratsuka et al.

(10) Patent No.: US 9,127,864 B2
(45) Date of Patent: Sep. 8, 2015

(54) REGENERATIVE REFRIGERATOR

(71) Applicant: SUMITOMO HEAVY INDUSTRIES, LTD., Tokyo (JP)

(72) Inventors: Yoshikatsu Hiratsuka, Tokyo (JP); Kyosuke Nakano, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 203 days.

(21) Appl. No.: 13/788,601

(22) Filed: Mar. 7, 2013

(65) Prior Publication Data

US 2013/0247592 A1 Sep. 26, 2013

(30) Foreign Application Priority Data

Mar. 21, 2012 (JP) ..... 2012-063187

(51) Int. Cl.
*F25B 9/00* (2006.01)
*F25B 9/14* (2006.01)

(52) U.S. Cl.
CPC . *F25B 9/00* (2013.01); *F25B 9/145* (2013.01); *F25B 2309/1408* (2013.01); *F25B 2309/1415* (2013.01); *F25B 2309/1423* (2013.01); *F25B 2400/073* (2013.01)

(58) Field of Classification Search
CPC .... F25B 9/00; F25B 9/145; F25B 2309/1408; F25B 2309/1415; F25B 2400/073; F25B 2309/1423
USPC ..... 62/6, 3.1, 527; 60/520
See application file for complete search history.

(56) References Cited

U.S. PATENT DOCUMENTS

| | | | | |
|---|---|---|---|---|
| 4,206,609 | A * | 6/1980 | Durenec | 62/6 |
| 4,277,948 | A * | 7/1981 | Horn et al. | 62/6 |
| 4,365,982 | A * | 12/1982 | Durenec | 62/6 |
| 4,366,676 | A * | 1/1983 | Wheatley et al. | 62/6 |
| 4,409,793 | A * | 10/1983 | Durenec | 62/6 |
| 4,711,650 | A * | 12/1987 | Faria et al. | 62/6 |
| 5,345,769 | A * | 9/1994 | Liepert et al. | 62/6 |
| 5,447,034 | A * | 9/1995 | Kuriyama et al. | 62/51.1 |
| 6,378,312 | B1 * | 4/2002 | Wang | 62/6 |
| 2001/0025494 | A1 * | 10/2001 | Okamura et al. | 62/6 |
| 2002/0026799 | A1 * | 3/2002 | Okamura et al. | 62/6 |
| 2003/0192324 | A1 * | 10/2003 | Smith et al. | 62/6 |
| 2004/0187456 | A1 * | 9/2004 | Bruck | 55/487 |
| 2005/0147541 | A1 * | 7/2005 | Ajisaka et al. | 422/177 |
| 2006/0042235 | A1 * | 3/2006 | Kaboord | 60/286 |
| 2006/0118273 | A1 * | 6/2006 | Qiu et al. | 165/10 |
| 2007/0205720 | A1 * | 9/2007 | Sparks et al. | 313/553 |

(Continued)

FOREIGN PATENT DOCUMENTS

| | | |
|---|---|---|
| JP | 05-156241 | 6/1993 |
| JP | H09-178278 | 7/1997 |

(Continued)

*Primary Examiner* — Mohammad M Ali
(74) *Attorney, Agent, or Firm* — IPUSA, PLLC

(57) ABSTRACT

A regenerative refrigerator includes a regenerator disposed in a flow passage of working gas generating a cold thermal mass, the regenerator being loaded with a regenerative material to accumulate cold thermal energy from the cold thermal mass in the working gas, wherein the regenerative material is a sintered body made of a fiber material, and a diameter of the fiber material disposed at a low-temperature end of the regenerator is smaller than a diameter of the fiber material disposed at a high-temperature end of the regenerator.

4 Claims, 5 Drawing Sheets

(56) References Cited

U.S. PATENT DOCUMENTS

| | | | | |
|---|---|---|---|---|
| 2007/0271751 | A1* | 11/2007 | Weidman | 29/25.03 |
| 2007/0274858 | A1* | 11/2007 | Childers et al. | 422/28 |
| 2008/0104967 | A1* | 5/2008 | Satoh | 62/6 |
| 2008/0110180 | A1* | 5/2008 | Watanabe et al. | 62/6 |
| 2009/0000313 | A1* | 1/2009 | Bin-Nun | 62/6 |
| 2010/0200389 | A1* | 8/2010 | Batrol | 202/259 |

FOREIGN PATENT DOCUMENTS

| | | |
|---|---|---|
| JP | 2002-206816 | 7/2002 |
| JP | 2003-148822 | 5/2003 |
| JP | 2008-096040 | 4/2008 |

* cited by examiner

REGENERATIVE REFRIGERATOR

RELATED APPLICATION

Priority is claimed to Japanese Priority Application No. 2012-063187, filed on Mar. 21, 2012, with the Japanese Patent Office, the entire contents of which are hereby incorporated by reference.

BACKGROUND

1. Technical Field

The present invention relates to a regenerative refrigerator, and specifically to a regenerative refrigerator using a regenerative material.

2. Description of Related Art

For example, a refrigerator such as a Gifford-McMahon refrigerator (referred to as a "GM refrigerator", hereinafter), a Stirling refrigerator, a pulse tube refrigerator, or the like, is configured to obtain a low temperature using a regenerator in which a regenerative material is loaded.

For example, a pulse tube refrigerator has a compressor, a pulse tube, a regenerator, and a phase control section, and the like. High-pressure working gas generated in the compressor passes through the regenerator and the pulse tube, then flows into the phase control section. The phase control section generates a phase difference between varying pressure and varying flow, oscillating like sine waves, of the working gas supplied from the compressor in the pulse tube. Thus, a cold thermal mass is generated between the pulse tube and the regenerator.

A regenerative material is loaded inside of the regenerator. The regenerative material is cooled by the cooled working gas returning to the compressor, and also refrigerates the working gas flowing into the pulse tube. Therefore, refrigeration efficiency of a refrigerator can be improved by providing a regenerator. As a regenerative material, for example, a compressed and sintered body of multiple regenerator plates made of a metallic fiber randomly stacked may be used.

SUMMARY

According to at least one embodiment of the present invention, a regenerative refrigerator includes a regenerator disposed in a flow passage of working gas generating a cold thermal mass, the regenerator being loaded with a regenerative material to accumulate cold thermal energy from the cold thermal mass in the working gas, wherein the regenerative material is a sintered body made of a fiber material, and a diameter of the fiber material disposed at a low-temperature end of the regenerator is smaller than a diameter of the fiber material disposed at a high-temperature end of the regenerator.

According to at least one embodiment of the present invention, it is possible to provide a regenerative refrigerator with a regenerative material having improved regeneration efficiency to improve refrigeration efficiency.

BRIEF DESCRIPTION OF THE DRAWINGS

Other objects and further features of embodiments will be apparent from the following detailed description when read in conjunction with the accompanying drawings, in which.

DETAILED DESCRIPTION

The invention will now be described by reference to the preferred embodiments. This does not intend to limit the scope of the present invention, but to exemplify the invention.

A regenerative material may use a metallic fiber having the same diameter (fiber diameter) from a high-temperature end to a low-temperature end of the regenerator. Moreover, a porosity of the metallic fiber in the regenerator is set to the same value from the high-temperature end to the low-temperature end of the regenerator.

Incidentally, a temperature at the high-temperature end of the regenerator, for example, may be about 300 K, whereas a temperature at the low-temperature end of the regenerator may be, for example, about 80 K. A higher temperature at the high-temperature end of the regenerator induces a tendency that viscosity of the working gas becomes higher and the fluid resistance becomes higher. On the other hand, the lower temperature at the low-temperature end induces a tendency that viscosity of the working gas becomes lower and the fluid resistance becomes lower.

Therefore, when the cooled low-viscosity working gas flows at the low-temperature end, heat exchange efficiency gets worse if the fiber diameter of the regenerative material is large and the porosity is large, which results in a problem that the regenerator cannot accumulate cold thermal energy efficiently.

Also, when the working gas reaches the high-temperature end, the temperature of the working gas becomes high, and the viscosity also becomes high. Therefore, if the fiber diameter of the regenerative material is small and the porosity is small, there is a problem that fluid resistance of the working gas generates greater cooling loss.

Figure 1:
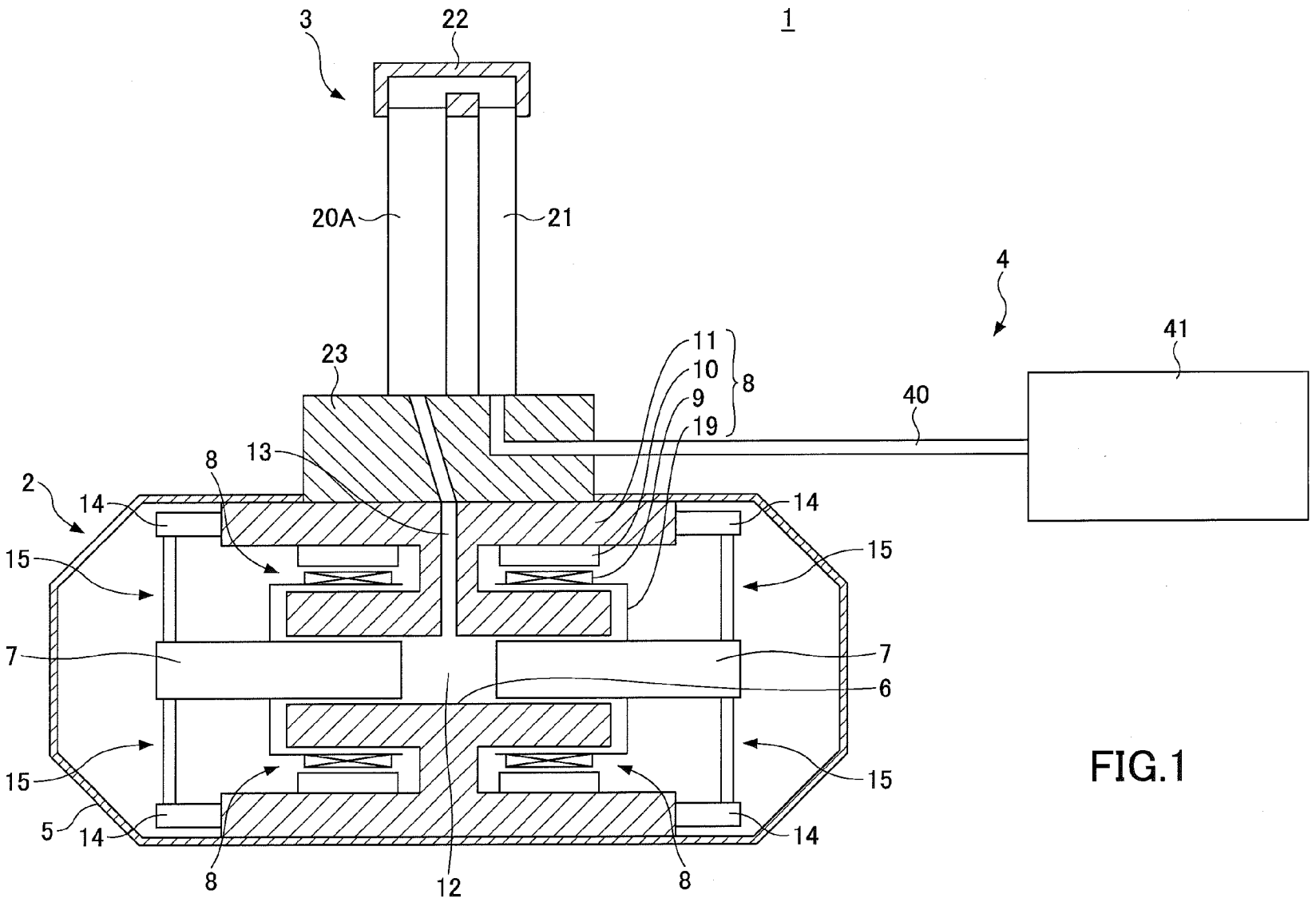
FIG. 1 is a cross-sectional view of a refrigerator according to an embodiment of the present invention.

FIG. 1 shows a regenerative refrigerator according to a first embodiment of the present invention. A Stirling pulse-tube refrigerator 1 (called simply a refrigerator, hereafter) is explained as an example of a regenerative refrigerator of the present embodiment. The refrigerator 1 has, in broad outline, a compressor 2, an extender 3, and a phase control section 4.

The compressor 2 is configured with a cylinder 6, pistons 7, linear motors 8, plate spring units 15, and the like in a housing 5.

The cylinder 6 is disposed at the center of the housing 5, extended in the horizontal direction in FIG. 1. In the cylinder 6, a pair of pistons 7 are disposed opposite each other. The pistons 7 in the cylinder 6 are configured to be capable of making reciprocal motion in the axial direction (the horizontal direction in FIG. 1). In between the pair of the pistons 7, a compressing chamber 12 is formed. The compressing chamber 12 communicates with the expander 3 via a passage 13.

A linear motor 8 is provided for each of the pistons 7. The linear motor 8 drives the piston to make reciprocal motion in the cylinder 6. The linear motor 8 is configured with a permanent magnet 9, an electromagnetic coil 10, a yoke 11, and a support holder 19.

The permanent magnet 9 is fixed to the piston 7 by the support holder 19. Therefore, the permanent magnet 9 moves in conjunction with the piston 7. Also, the yoke 11 is fixed to the housing 5. A ring-shaped concave section is formed on the yoke 11, to make the permanent magnet 9 movable in the axial direction in the concave section.

The electromagnetic coil 10 is fixed at a position opposite to the permanent magnet 9 in the concave section of the yoke 11. Alternating current oscillating with a prescribed frequency is supplied to the electromagnetic coil 10 from a power source (not shown). Once the alternating current is supplied to the electromagnetic coil 10, driving force is generated between the permanent magnet 9 and the electromagnetic coil 10 in the axial direction. As mentioned earlier, since the electromagnetic coil 10 is fixed on the yoke 11, the piston 7 is driven in the cylinder 6 in the axial direction by the driving force generated with the linear motor 8.

The plate spring unit 15 has its external circumference fixed to the housing 5 via the support member 14, as well as having its internal circumference fixed to the piston 7. The plate spring unit 15 has a function to support the piston 7 to make reciprocal motion in the compressor 2. Therefore, when the piston 7 is driven in the axial direction by the linear motor 8, the plate spring unit 15 allows the piston 7 to move in the axial direction, and after the piston 7 has moved, biases the piston 7, with an elastic repulsive force, towards the direction opposite the driving direction of the linear motor 8.

Thus, each of the pistons 7 reciprocates in the axial direction in the cylinder. 6, to oscillate the pressure of the working gas in the compressing chamber 12. The varying pressure of the working gas in the compressing chamber 12 is supplied to the expander 3 via the passage 13, to generate a cold thermal mass in the expander 3.

The expander 3 has a regenerator 20A, a pulse tube 21, a low-temperature heat exchanger 22, and the like, to be configured in a pulse tube refrigerator.

The regenerator 20A is disposed in the middle of a flow passage of the working gas flowing from the compressor 2 to the pulse tube 21. The regenerator 20A is configured to have loaded a regenerative material 30A (see FIG. 2, the regenerative material 30A will be described later) to accumulate cold thermal energy in its inner part of a cylindrical body.

The pulse tube 21 is a cylindrical tube, communicating with the regenerator 20A via a passage 22a provided in the low-temperature heat exchanger 22.

It is noted that although in the present embodiment, the regenerator 20A and the pulse tube 21 are connected with a folded connection, it is possible to adopt an in-line connection.

Next, operations of the pulse tube refrigerator 1 will be explained. Energy of the working gas supplied by the compressor 2 is transferred through the regenerator 20A, the low-temperature heat exchanger 22, and the pulse tube 21 in that order, to be consumed at the phase control section 4. The phase control section 4 is configured with, for example, an inertance tube 40 and a buffer tank 41, to generate a phase difference between pressure and displacement of the working gas in the pulse tube 21.

Between the regenerator 20A and the pulse tube 21, an energy gap is generated due to work done when the working gas having the generated phase difference transitions from an isothermal state to an adiabatic state. To compensate for the gap, heat is absorbed at the low-temperature heat exchanger 22, which generates a cold thermal mass. On the other hand, at a radiator 23 disposed at the higher temperature side of the pulse tube 21 (the lower end of the pulse tube 21 in FIG. 1), the heat absorbed at the low-temperature heat exchanger 22 is radiated. By repeating the series of operations, an object to be cooled, thermally connected to the low-temperature heat exchanger 22, is cooled.

Next, the regenerator 20A, which is a part of the expander 3, will be explained with reference to FIG. 2.

The regenerator 20A is configured with a main body 25, a spacer 24, the regenerative material 30A, and the like. The main body 25 is, for example, a cylinder-shaped part made of stainless steel. The regenerative material 30A and the spacer 24 are loaded inside of the main body 25. The spacer 24 is disposed at a closer position to the high-temperature end PH than the position of the regenerative material 30A. A flow passage 24*a* formed in the middle of the spacer 24 communicates with the passage 13.

The regenerative material 30A is a sintered body made of, for example, a fiber material of copper or copper alloy, which has a high thermal conductivity, woven into mesh or stacked randomly, then heated to be sintered. Therefore, the regenerator 20A can be assembled by simply inserting and attaching the regenerative material 30A, or the sintered body, into the main body 25, which improves efficiency of the assembly.

Figure 2:
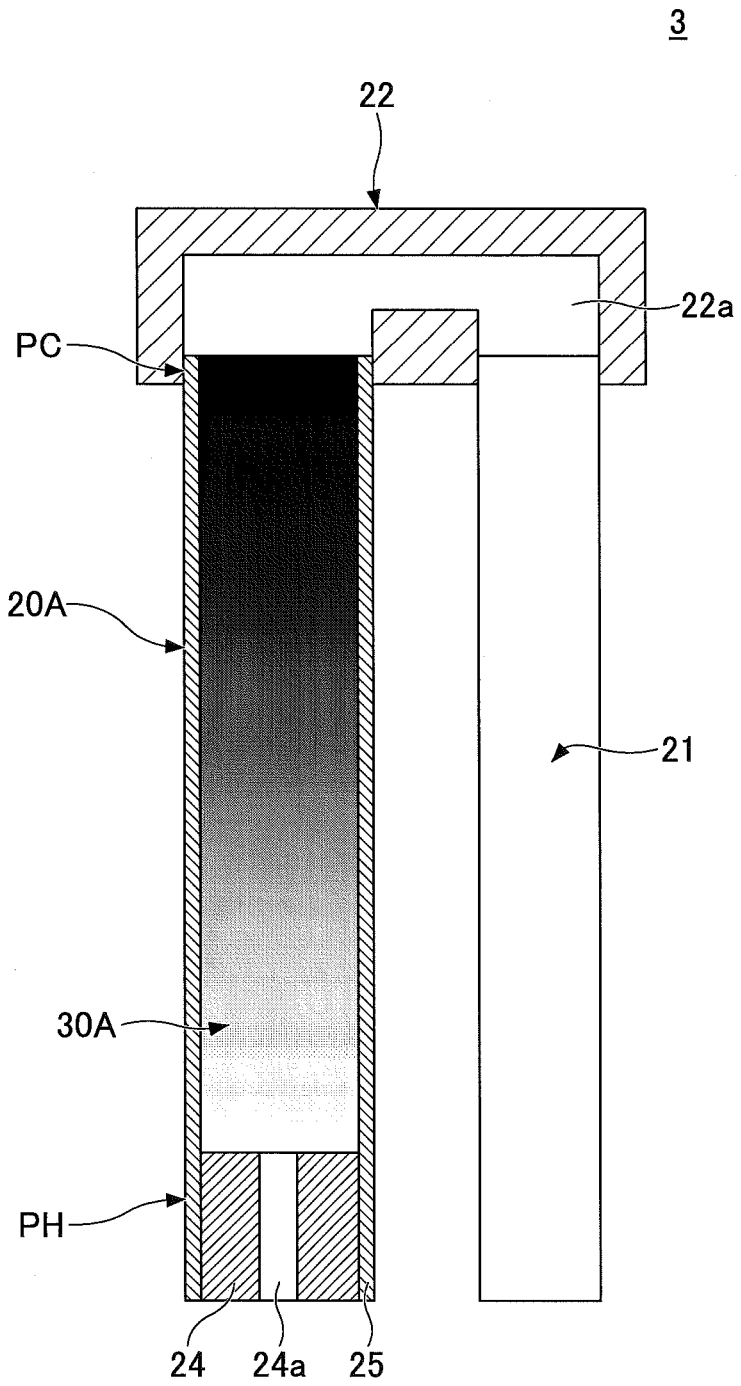
FIG. 2 is a cross-sectional view of a regenerator provided in the refrigerator according to an embodiment of the present invention.

Also, in the regenerative material 30A according to the present embodiment, the diameter of a piece of the fiber material (fiber diameter) is thinner at the low-temperature end of the regenerator 20A (shown in FIG. 2 with an arrow PC) than at the high-temperature end (shown in FIG. 2 with an arrow PH). Also, in between the low-temperature end PC and the high-temperature end PH, the diameter of a piece of the fiber material becomes gradually smaller while moving towards the low-temperature end PC.

For example, diameters of the fiber material may be 0.02 mm at the low-temperature end PC and 0.05 mm at the high-temperature end PH in a refrigerator 1 in which a temperature at the high-temperature end PH is 300 K and a temperature at the low-temperature end PC is 80 K.

Also, by having different fiber diameters in the regenerator 20A as in the present embodiment, a porosity formed in the regenerative material 30A is also varied between the low-temperature end PC and the high-temperature end PH. In the present embodiment, for example, the porosity at the low-temperature end PC is 30%, whereas the porosity at the high-temperature end PH is 70%. Also, in between the low-temperature end PC and the high-temperature end PH, a porosity of the fiber material becomes gradually smaller while moving towards the low-temperature end PC.

The working gas flowing inside of the regenerator 20A does not have uniform characteristics between the low-temperature end PC and the high-temperature end PH of the regenerator 20A. At the low-temperature end PC, the temperature may go down to a cryogenic temperature, such as 80 K, whereas the temperature at the high-temperature end PH may be 300 K, which is a relatively high temperature compared to the temperature at the low-temperature end PC. Therefore, the working gas has low viscosity at the low-temperature end PC, and high viscosity at the high-temperature end PH.

Here, attention will be paid to the low-temperature end PC of the regenerative material 30A. As described above, the fiber diameter is small, and the porosity is also small. Therefore, fluid resistance of the regenerative material 30A is large at the low-temperature end PC.

First, suppose that the working gas cooled due to an expansion flows to the compressor 2, starting from the pulse tube 21 through the regenerator 20A. In this case, the cooled working gas having a low temperature and low viscosity flows into the low-temperature end PC of the regenerator 20A.

Here, due to the low viscosity of the working gas at the low-temperature end PC, the fiber diameter can be made relatively small to make a diameter of the flow passage small. On the other hand, at the high-temperature end PH, due to the high viscosity, the fiber diameter is made relatively large to make a diameter of the flow passage large. Therefore, at the low-temperature end PC, the regenerative material 30A can accumulate cold thermal energy efficiently. Also, in addition to fiber diameter, it is desirable to adjust porosity.

Having passed the low-temperature end PC, the working gas flows to the high-temperature end PH. As the fiber diameter and porosity increase gradually while moving towards the high-temperature end PH, the low-temperature end PC has a larger heat transfer area to exchange much more heat than the high-temperature end PH.

Next, suppose that the working gas compressed by the compressor 2 flows from the regenerator 20A to the pulse tube 21. In this case, the working gas compressed by the compressor, having a high temperature and high viscosity, first flows into the high-temperature end PH of the regenerator 20A. Then, the working gas flows from the high-temperature end PH to the low-temperature end PC of the regenerative material 30A while being cooled by the regenerative material 30A, to reach the pulse tube 21 where the working gas is expanded to generate a cold thermal mass. By repeating the series of operations, an object to be cooled is cooled. In the refrigerator 1 according to the present embodiment, because the fiber diameter at the high-temperature end PH is larger than the fiber diameter at the low-temperature end PC, heat loss in the regenerator 20A is reduced, which improves refrigeration efficiency of the refrigerator 1.

Next, a second and third embodiment of the present invention will be explained.

Figure 3:
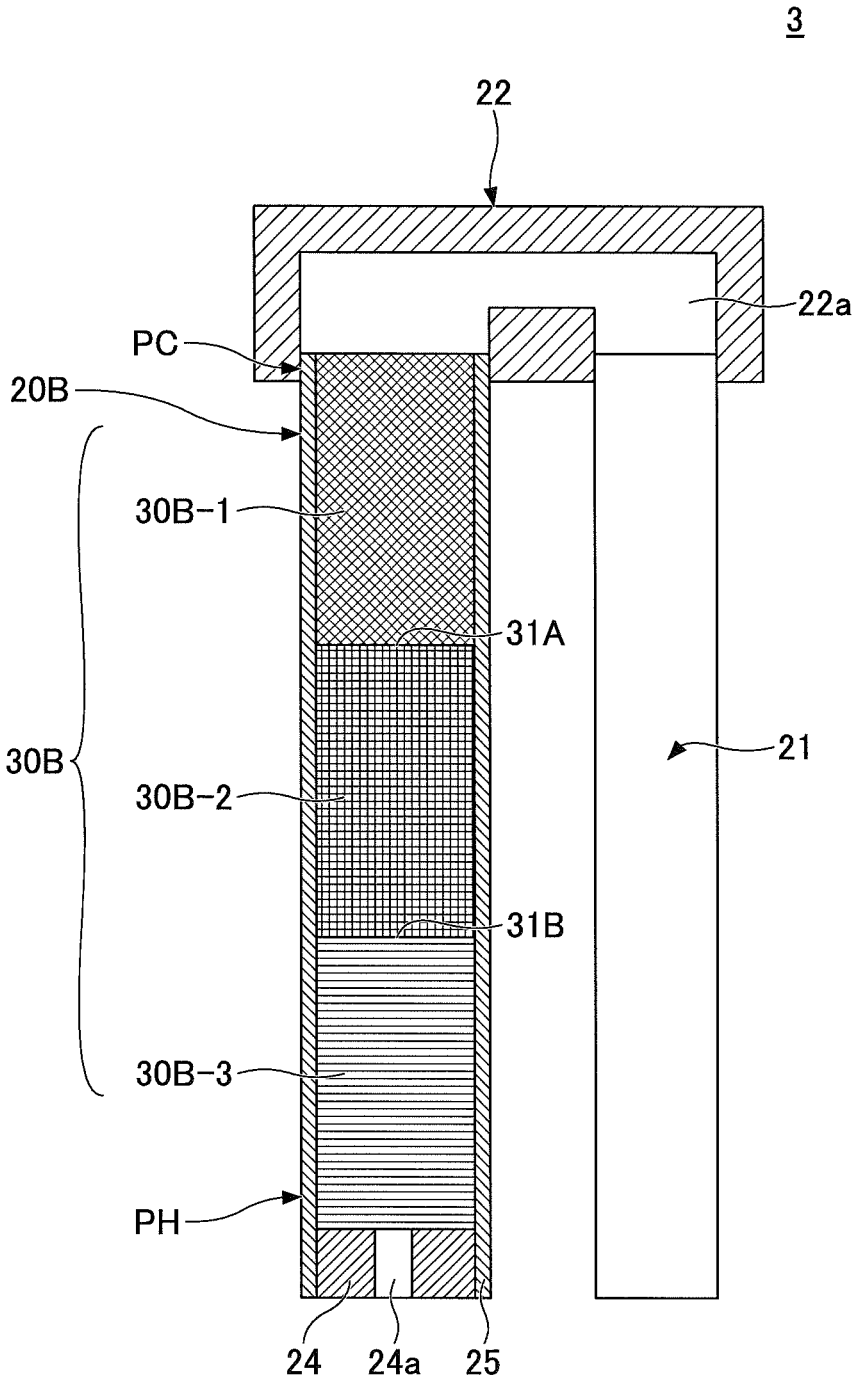
FIG. 3 is a cross-sectional view of a regenerator provided in the refrigerator according to another embodiment of the present invention.

FIG. 3 shows a regenerative material 30B disposed in a regenerator 20B according to the second embodiment. Also, FIG. 4 shows a regenerative material 30C disposed in a regenerator 20C according to the third embodiment.

Figure 4:
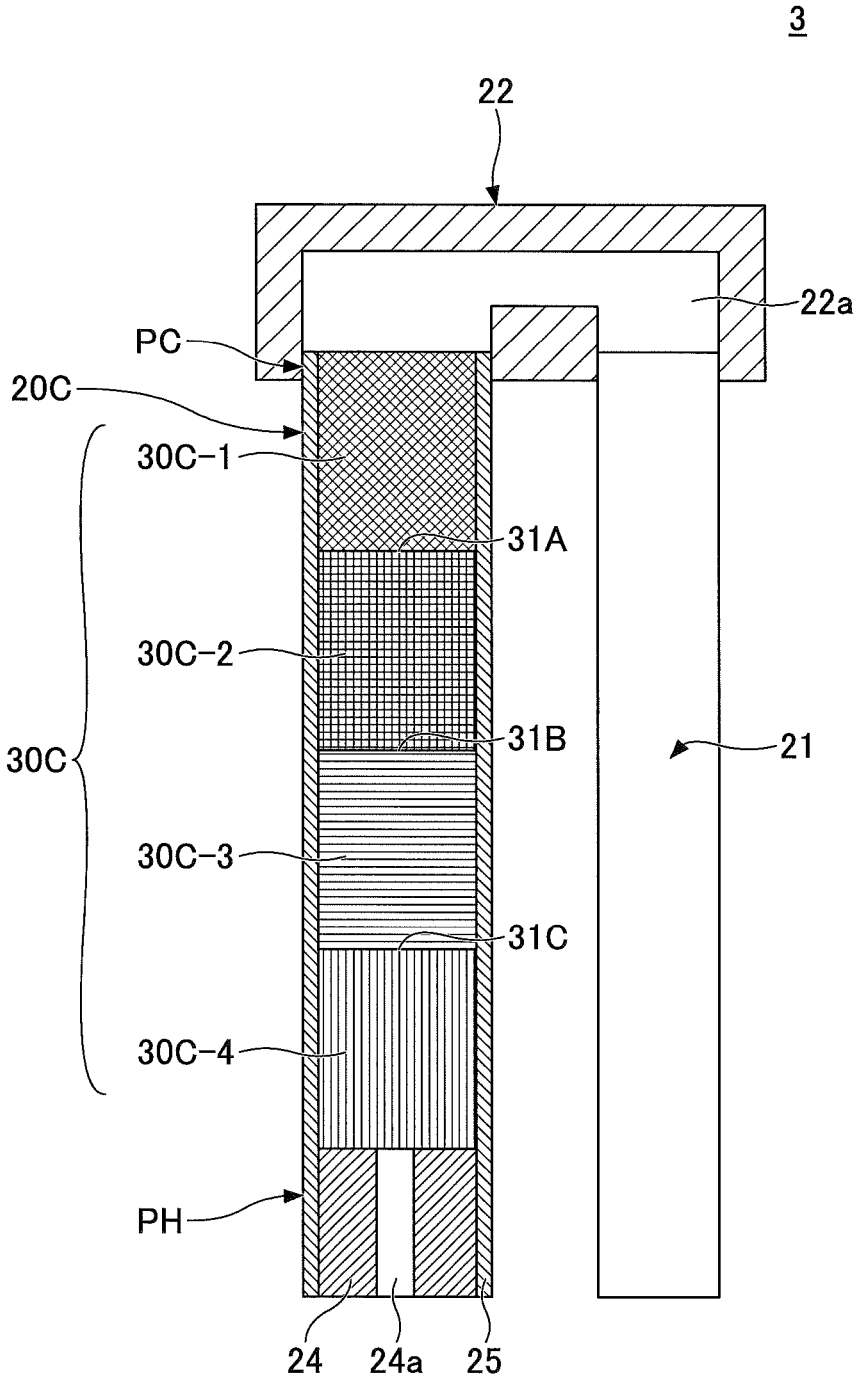
FIG. 4 is a cross-sectional view of a regenerator provided in the refrigerator according to yet another embodiment of the present invention.

In FIGS. 3 and 4, the same numeral codes are attached to parts having the corresponding parts in FIGS. 1 and 2 used for describing the first embodiment, whose explanation is skipped here. Also, since the second or third embodiment is characterized by the regenerative material 30B or 30C, respectively, and other parts are configured in the same way as in the refrigerator 1 according to the first embodiment, FIG. 3 or 4 only shows the regenerative material 30B or 30C, respectively, without showing the other parts.

In the first embodiment above, the regenerative material 30A is made in a single unit from the low-temperature end PC to the high-temperature end PH, with the fiber diameter becoming gradually smaller from the high-temperature end PH to the low-temperature end PC. On the other hand, the second or third embodiment is characterized by having the respective regenerative material 30B or 30C divided into multiple subunits, in which a diameter of a piece of the fiber material in a subunit is changed depending on where the subunit is placed between the low-temperature end PC and the high-temperature end PH.

In the second embodiment shown in FIG. 3, the regenerative material 30B is divided into three subunits. Namely, the regenerative material 30B is configured with a first subunit of the regenerator 30B-1, a second subunit of the regenerator 30B-2, and a third subunit of the regenerator 30B-3. Also, in the third embodiment shown in FIG. 4, the regenerative material 30C is divided into four subunits. Namely, the regenerative material 30C is configured with a first subunit of the regenerator 30C-1, a second subunit of the regenerator 30C-2, a third subunit of the regenerator 30C-3, and a fourth subunit of the regenerator 30C-4.

Each of the subunits 30B-1 to 30B-3 and 30C-1 to 30C-4 is a sintered body made of, for example, a fiber material of copper or copper alloy, which has high thermal conductivity, woven into mesh or stacked randomly, then heated to be sintered. Therefore, the regenerator 20B or 20C can be assembled by simply inserting and attaching the subunits 30B-1 to 30B-3 or 30C-1 to 30C-4, respectively, into the main body 25 in an order that will be described later, which improves efficiency of the assembly.

Also, by inserting and attaching the subunits 30B-1 to 30B-3 or 30C-1 to 30C-4 into the main body 25, boundary sections 31A to 31B are formed between the subunits 30B-1 to 30B-3, or boundary sections 31A to 31C are formed between the subunits 30C-1 to 30C-4, respectively.

Next, a specific configuration of the subunits 30B-1 to 30B-3 or 30C-1 to 30C-4 will be explained, respectively.

First, the first to the third subunits 30B-1 to 30B-3 in the second embodiment will be explained. Suppose that the first subunit of the regenerator 30B-1 has a fiber diameter of DB1 mm and a porosity of SB1, the second subunit of the regenerator 30B-2 has a fiber diameter of DB2 mm and a porosity of SB2, and the third subunit of the regenerator 30B-3 has a fiber diameter of DB3 mm and a porosity of SB3.

The regenerator 20B in the second embodiment is characterized by the fiber diameters of the subunits 30B-1 to 30B-3 satisfying conditions, $DB1<DB3$, $DB1\leq DB2$, and $DB2\leq DB3$, and the porosity satisfying conditions, $SB1<SB3$, $SB1\leq SB2$ and $SB2\leq SB3$.

Configured in this way, in the regenerator 20B in the second embodiment, similar to the regenerator 20A in the first embodiment, the fiber diameter and porosity are smaller at the low-temperature end PC than at the high-temperature end PH. Also, in between the low-temperature end PC and the high-temperature end PH, the diameter and porosity become gradually smaller while moving towards the low-temperature end PC in the regenerator 20B.

Next, the first to the fourth subunits 30C-1 to 30C-4 in the third embodiment will be explained. Suppose that the first subunit of the regenerator 30C-1 has a fiber diameter of DC1 mm and a porosity of SC1, the second subunit of the regenerator 30C-2 has a fiber diameter of DC2 mm and a porosity of SC2, the third subunit of the regenerator 30C-3 has a fiber diameter of DC3 mm and a porosity of SC3, and the fourth subunit of the regenerator 30C-4 has a fiber diameter of DC4 mm and a porosity of SC4.

The regenerator 20C in the third embodiment is characterized by the fiber diameters of the subunits 30C-1 to 30C-4 satisfying conditions, $DC1<DC4$, $DC1\leq DC2$, $DC2\leq DC3$, and $DC3\leq DC4$, and the porosity satisfying conditions, $SC1<SC4$, $SC1\leq SC2$, $SC2\leq SC3$, and $SC3\leq SC4$.

Configured in this way, in the regenerator 20C in the second embodiment, similar to the regenerator 20A in the first embodiment, the fiber diameter and porosity are smaller at the low-temperature end PC than at the high-temperature end PH. Also, in between the low-temperature end PC and the high-temperature end PH, the diameter and porosity become gradually smaller while moving towards the low-temperature end PC in the regenerator 20C.

As described above, in the second and third embodiments, the fiber diameter and porosity are smaller at the low-temperature end PC than at the high-temperature end PH. Therefore, similar to the first embodiment, it is possible to refrigerate the regenerative material 30B or 30C efficiently when the working gas flows to the compressor from the pulse tube 21 to the regenerator 20B or 20C, and to refrigerate the working gas efficiently when the working gas flows to the pulse tube 21 from the regenerator 20B or 20C. Therefore, according to the second or third embodiment, heat loss in the regenerator 20B or 20C is reduced, which improves refrigeration efficiency.

Figure 5:
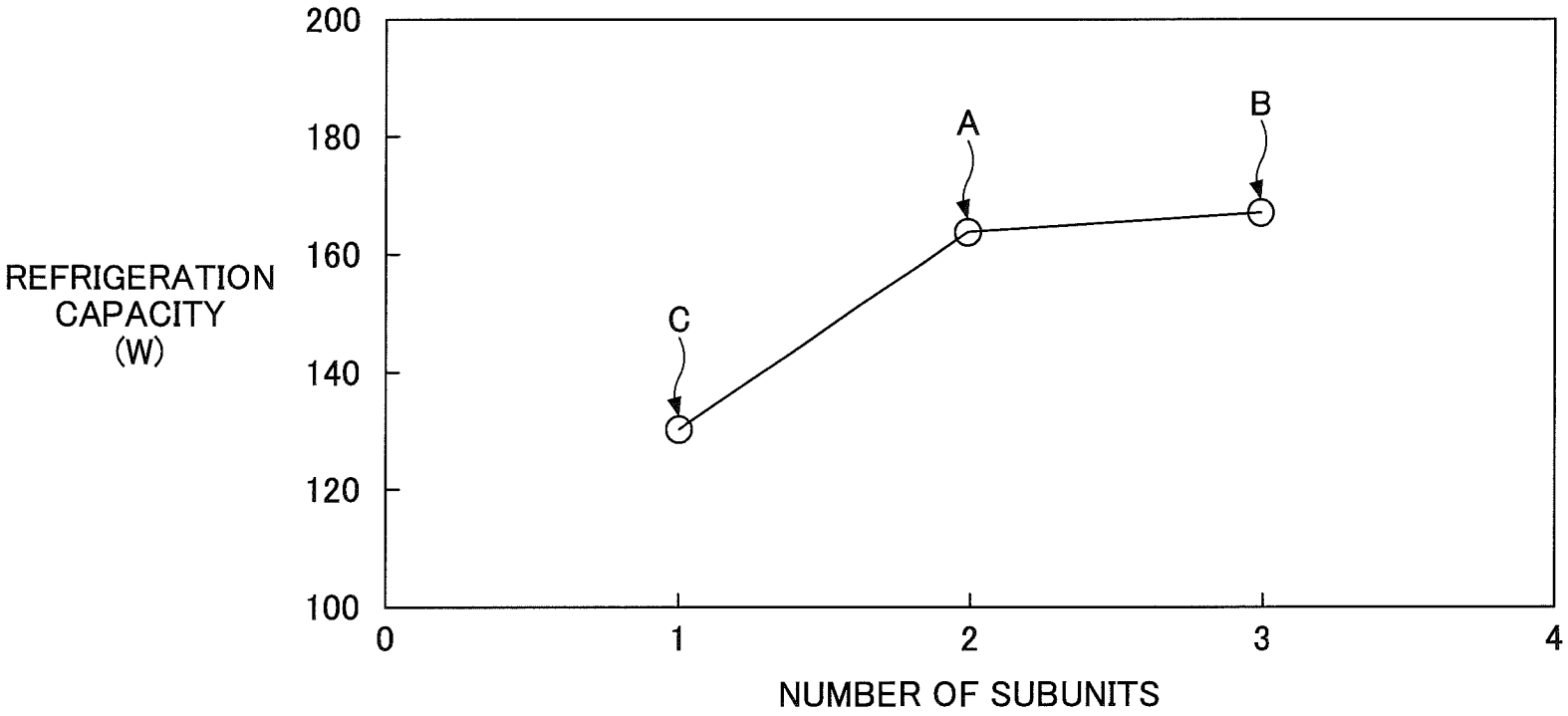
FIG. 5 is a graph showing a comparison result of refrigeration efficiency between a conventional refrigerator and refrigerators according to embodiments.

FIG. 5 is a graph showing a comparison result of refrigeration efficiency between a conventional refrigerator and refrigerators according to the second and third embodiments. In FIG. 5, the horizontal axis indicates the number of partitions of the regenerative material, and the vertical axis indicates refrigeration capacity (W). Also, an arrow A in FIG. 5 indicates the refrigeration capacity of the refrigerator using the refrigerator material 30B divided into three subunits, and an arrow B in FIG. 5 indicates the refrigeration capacity of the refrigerator using the refrigerator material 30C divided into four subunits.

In the experiment from which the result shown in FIG. 5 was derived, the regenerative material 30B according to the second embodiment is used, in which the first subunit 30B-1 has a fiber diameter of 0.023 mm and a porosity of 50%, and the second and third subunits 30B-2 and 30B-3 have a fiber diameter of 0.04 mm and a porosity of 70%.

Also, a regenerative material 30C according to the third embodiment is used, in which the first subunit 30C-1 has a fiber diameter of 0.023 mm and a porosity of 40%, the second and third subunits 30C-2 and 30C-3 have a fiber diameter of 0.04 mm and a porosity of 50%, and the fourth subunit 30C-4 has a fiber diameter of 0.05 mm and a porosity of 70%.

An arrow C in FIG. 5 indicates the refrigeration capacity of a conventional refrigerator that has uniform characteristics from the low-temperature end PC to the high-temperature end PH. Also, all the refrigerators are set with a cooling temperature of 77 K at the low-temperature end PC.

As shown in FIG. 5, the refrigeration capacity of the refrigerator indicated by the arrow A or B according to the second or the third embodiment is improved considerably compared to the refrigeration capacity of the conventional refrigerator indicated by the arrow C. In other words, FIG. 5 demonstrates that it is possible to obtain a higher refrigeration capacity than that obtained by refrigerators of the prior art by using the regenerative material 30B or C which has a smaller diameter of the fiber material and a smaller porosity at the low-temperature end PC than at the high-temperature end PH.

Comparing the refrigeration capacities of the refrigerator A according to the second embodiment and the refrigerator B according to the third embodiment, the refrigerator B that has a larger number of partitions has a higher refrigeration capacity.

This result comes from the fact that a larger number of partitions of the regenerative material also increases the number of boundary sections. The reason for this can be explained as follows.

By dividing a regenerative material as in the second or third embodiment, boundary sections are formed between the partitioned subunits. Specifically, in the second embodiment, there are two boundary sections 31A and 31B formed between the first to third subunits 30B-1 to 30B-3, and in the third embodiment, there are three boundary sections 31A to 31C formed between the first to fourth subunits 30C-1 to 30C-4.

At these boundary sections 31A to 31C, the subunits 30B-1 to 30B-3 and 30C-1 to 30C-4 are separated, which forms minute gaps at the boundary sections 31A to 31C. Therefore, thermal conductivity at these boundary sections is smaller than the thermal conductivity of the subunits 30B-1 to 30B-3 and 30C-1 to 30C-4.

This prevents cold thermal energy accumulated at the first subunit 30B-1 or 30C-1, which is disposed closer to the low-temperature end PC, from being reduced by heat transferred to the second subunit 30B-2 or 30C-2 by heat conduction. Also, it prevents high-temperature thermal energy accumulated at the third subunit 30B-3 or the fourth subunit 30C-4, which is disposed closer to the high-temperature end PH, from being transferred by heat conduction to the second subunit 30B-2 or the third subunit 30C-3.

Thus, by dividing a regenerator into subunits, the subunits are separated thermally at boundary sections, with which the low-temperature end PC can maintain a low-temperature state. Therefore, by increasing the number of partitions to increase the number of boundary sections dividing the regenerator thermally, it is possible to more efficiently keep a low temperature at the low-temperature end PC. For this reason, refrigeration capacity of a refrigerator can be improved by increasing the number of partitions of the regenerative material.

As above, the present invention has been described in detail with reference to preferred embodiments thereof. Further, the present invention is not limited to these embodiments, examples and aspects, but various variations and modifications may be made without departing from the scope of the present invention.

Specifically, in the second and third embodiments above, it was assumed that each of the subunits 30B-1 to 30B-3 and 30C-1 to 30C-4 has the same fiber diameter and porosity within an individual subunit. However, it is possible to vary the fiber diameter and porosity at the high-temperature end PH and a low-temperature end PC within the individual subunits 30B-1 to 30B-3 or 30C-1 to 30C-4.

Also, in the second embodiment above, the regenerative material 30B is divided into three subunits, and the third embodiment, the regenerative material 30C is divided into four subunits. The number of partitions, however, is not limited to these numbers, but other numbers can be selected as appropriate.

It should be understood that the invention is not limited to the above-described embodiments, but may be modified into various forms on the basis of the spirit of the invention. Additionally, the modifications are included in the scope of the present invention.

What is claimed is:

1. A regenerative refrigerator comprising a regenerative material and a regenerator disposed in a flow passage of working gas generating a cold thermal mass, the regenerator being loaded with the regenerative material to accumulate cold thermal energy from the cold thermal mass in the working gas, wherein the regenerative material is a sintered body made of a fiber material, and a diameter of the fiber material disposed at a low-temperature end of the regenerator is smaller than a diameter of the fiber material disposed at a high-temperature end of the regenerator, wherein the regenerator includes a single cylindrical main body into which the regenerative material is inserted, and wherein the single cylindrical main body has a constant diameter.

2. The regenerative refrigerator as claimed in claim 1, wherein a porosity of the fiber material disposed at the low-temperature end of the regenerator is smaller than a porosity of the fiber material disposed at the high-temperature end of the regenerator.

3. The regenerative refrigerator as claimed in claim 1, wherein the regenerative material is divided into multiple subunits.

4. The regenerative refrigerator as claimed in claim 2, wherein the regenerative material is divided into multiple subunits.

* * * * *